US010909905B2

(12) United States Patent
Choi et al.

(10) Patent No.: US 10,909,905 B2
(45) Date of Patent: Feb. 2, 2021

(54) DISPLAY WITH SWITCHING CONFIGURABLE FOR POWER CONSUMPTION AND SPEED

(71) Applicant: Google LLC, Mountain View, CA (US)

(72) Inventors: Sangmoo Choi, Palo Alto, CA (US); Chang Ju Kang, Palo Alto, CA (US)

(73) Assignee: Google LLC, Mountain View, CA (US)

( * ) Notice: Subject to any disclaimer, the term of this patent is extended or adjusted under 35 U.S.C. 154(b) by 8 days.

(21) Appl. No.: 16/372,865

(22) Filed: Apr. 2, 2019

(65) Prior Publication Data

US 2020/0320923 A1 Oct. 8, 2020

(51) Int. Cl.
*G09G 3/36* (2006.01)
*G09G 3/20* (2006.01)

(52) U.S. Cl.
CPC ..... *G09G 3/2092* (2013.01); *G09G 2330/021* (2013.01)

(58) Field of Classification Search
CPC ..... G06F 3/041; G06F 3/045; G01R 27/26; G06K 11/06; G08C 21/00; G09G 3/36
See application file for complete search history.

(56) References Cited

U.S. PATENT DOCUMENTS 6,972,881 B1 12/2005 Bassetti
10,460,191 B1 * 10/2019 Pribble ..... G06K 9/3233
2003/0063048 A1 4/2003 Nakano et al.
2004/0008173 A1 * 1/2004 Maeda ..... G09G 3/3688 345/99
2004/0125008 A1 * 7/2004 Yamaji ..... H03M 1/007 341/155
2013/0321386 A1 12/2013 Murai et al.
2018/0268765 A1 * 9/2018 Okamoto ..... G09G 3/36
2019/0258114 A1 * 8/2019 Kwon ..... G09G 3/34

FOREIGN PATENT DOCUMENTS

EP 3276606 A1 1/2018

OTHER PUBLICATIONS

International Search Report and Written Opinion for Application No. PCT/US2019/062219, dated Feb. 12, 2020, 15 pages.

* cited by examiner

*Primary Examiner* — Pegeman Karimi
(74) *Attorney, Agent, or Firm* — Brake Hughes Bellermann LLP

(57) ABSTRACT

A flat panel display that includes a switch bank to couple a signal from a driver integrated circuit to a column data line of a display panel is disclosed. The switch bank can be adjusted based on the frame rate of the display. When the frame rate is high, all sub-switches in the switch bank may be used to reduce an ON resistance of the switch bank. This high frame rate configuration may maintain or increase the speed at which pixels can be controlled but consumes more power. Accordingly, when the frame rate is low, a portion of the sub-switches in the switch bank are unused to reduce the power consumed. This low frame rate configuration may maintain or decrease the speed at which pixels of the display can be controlled but consumes less power.

20 Claims, 6 Drawing Sheets

DISPLAY WITH SWITCHING CONFIGURABLE FOR POWER CONSUMPTION AND SPEED

FIELD OF THE DISCLOSURE

The present disclosure relates to a flat panel display and more specifically to a display system that can be configured to operate at a high frame rate or to consume less power.

BACKGROUND

In recent years, flat panel displays have become larger and/or changed shape. For example, aspect ratios of displays for mobile devices have increased from 16:9 to 21:9. Over the same period, maximum frequencies (i.e., frame rates) for these displays have increased. For example, frame rates of displays for mobile devices have increased from 60 Hertz (Hz) to 120 Hz. Both of these display trends correspond to an increase in power consumption.

When the length of a display is increased, each column of the display includes additional pixels. All pixels in each column are controlled by signals carried by a column data line. When the length of the display is increased, these signals must have a higher switching frequency in order to control the additional pixels. In other words, to maintain (or increase) a frame rate requires a high column line switching frequency (e.g., >100 kilohertz). At these frequencies, a parasitic capacitance of each column data line can negatively affect a time constant related to the switching of each pixel. As a result, larger switching devices must be used, but larger switching devices require more power. Accordingly, more power may necessary to achieve high frame rates for displays having high aspect ratios. This power consumption trend is shown in TABLE 1 for some example displays.

TABLE 1

Display Power Consumption

| Aspect Ratio | 18.5:9 | 19:9 | 21:9 |
|---|---|---|---|
| Frame Rate (Hz) | 60 | 90 | 120 |
| Column Line Switching Frequency | 89 | 137 | 202 |
| Normalized Power Consumption | 1 | 1.5 | 2.3 |

SUMMARY

In one general aspect, the disclosure describes a method for controlling a display. The method includes obtaining a frame rate for the display and determining if the frame rate is low (or high) based on a comparison of the frame rate to a threshold that defines a boundary between high frame rates and low frame rates. A panel-switch bank including a plurality of sub-switches is coupled between a driver IC and a column data line of the display. If the frame rate is low, then a portion of the plurality of sub-switches in the panel-switch bank are deactivated (i.e., receive a continuous OFF signal) to reduce a power consumption of the display.

Additionally, in some implementations, the method further includes determining that the frame rate is high, and while the frame rate is high, all of the plurality of sub-switches in the panel-switch bank are activated (i.e., receive ON/OFF signals for switching) to reduce a resistance (e.g., an ON resistance) of the panel-switch bank.

In some implementations a low frame rate is a frame rate below a threshold (e.g., 90 Hz) and a high frame rate is a frame rate above the threshold. For example, 60 Hz may be a low frame rate and 120 Hz may be a high frame rate in some implementations.

In another general aspect, the disclosure describes a display system. The display system includes a display panel that has columns of pixels. Each column of pixels is controlled by a column data line that is coupled through a panel-switch bank to a driver IC. The display system further includes a control that is configured to determine a frame rate of the display panel and to control the panel-switch bank based on the determined frame rate (e.g., as compared relative to a threshold).

In some implementations, the panel-switch bank of the display is coupled in series between the driver IC and a column data line and includes a plurality of sub-switches that are coupled in parallel to one another. The control of the panel-switch bank for these implementations includes (i) switching all sub-switches of each panel-switch bank ON and OFF together when the frame rate is high relative to a threshold and (ii) switching a portion of the sub-switches of each panel-switch bank ON and OFF together when the frame rate is low relative to a threshold. In the low frame rate case, the remaining portion of the sub-switches of the panel-switch bank are (continuously) switched OFF (i.e., unused) to save power.

In some implementations, the display system further includes a driver-switch bank that operates similarly to the panel-switch bank. Both the operation of the panel-switch bank and the driver-switch bank are controlled by a control. In some implementations, the control is part of the driver IC and in some implementations the control and the driver IC are physically separate from the driver IC.

In some implementations, the display panel has a high aspect ratio that is greater than 18.5 to 9 (18.5:9). For example, the aspect ratio may be 21:9.

In another general aspect, the disclosure describes a flat panel display. The flat panel display includes a plurality of panel-switch banks. Each panel-switch bank is configured to couple a driver IC to a column of pixels. Each panel-switch bank is configurable to couple using (i) a high frame rate configuration that increases the power consumed to provide a lower ON resistance of the panel-switch bank or (ii) a low frame rate configuration that provides a higher ON resistance of the panel-switch bank and reduces the power consumed by the panel-switch bank.

In some implementations each panel-switch bank includes a plurality of sub-switches that are connected in parallel with one another. In the high frame rate configuration, all of the sub-switches in each panel-switch bank are used to couple the driver IC to one column of pixels, while in the low frame rate configuration, a portion of the sub-switches in each panel-switch bank are used to couple the driver IC to one column of pixels.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The components in the drawings are not necessarily drawn to scale and are may not be in scale relative to each other. Like reference numerals designate corresponding parts throughout the several views.

DETAILED DESCRIPTION

The present disclosure describes a flat panel display that includes at least one switch bank to couple a driver integrated circuit (IC) to each column of pixels. The at least one switch bank includes a plurality of sub-switches that are connected in parallel and that are each controlled by a signal received from a control. The signals controlling the sub-switches are based on a frame rate of the display. When the flat panel display operates at a high frame rate, the control provides switching signals so that all of the sub-switches in a switch bank couple the driver IC to a column of pixels. This high frame rate configuration ensures that an ON resistance of the switch bank is low. The low ON resistance counteracts a capacitance (e.g., parasitic capacitance) of a column data line feeding the column of pixels, which increases with frame rate. When the flat panel display operates at a low frame rate, however, the control provides switching signals so that only a portion of the sub-switches in a switch bank couple the driver IC to a column of pixels. This low frame rate configuration ensures that the power consumed by the switch bank is low. This low power consumption helps reduce an overall power consumption of the display because, over time, the display may operate in both the high frame rate operation and the low frame rate operation.

Figure 1:
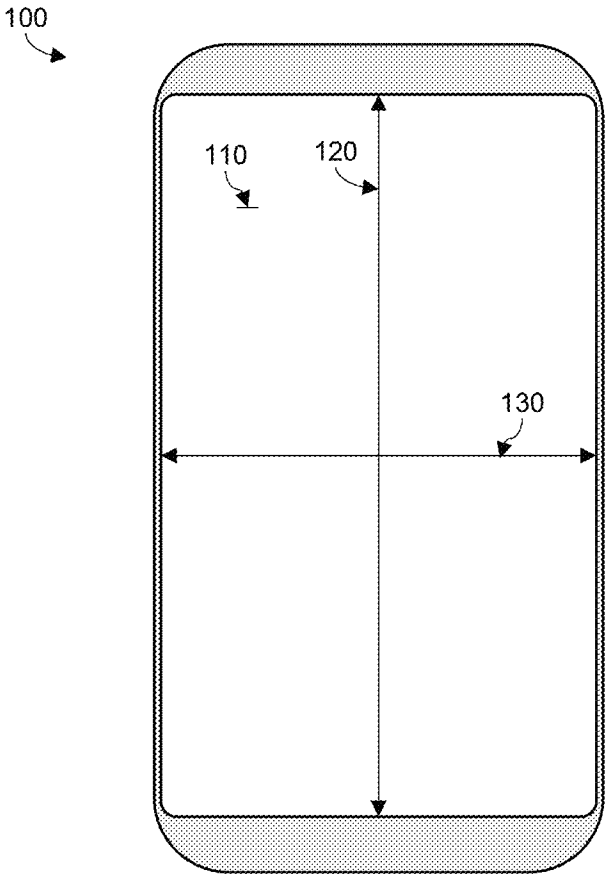
FIG. 1 depicts a possible front surface of a mobile device with a display.

FIG. 1 depicts an example of a mobile computing device (i.e., mobile device). A front surface of the mobile device 100 is shown. The front surface includes a display 110 having an aspect ratio (AR) defined as a ratio of a height 120 to a width 130 (i.e., AR=height/width). A display 110 for the mobile device 100 may have a height 120 that is more than twice the width 130. For example, a high AR display may have an AR that is greater than 18.5 to 9.

Figure 2:
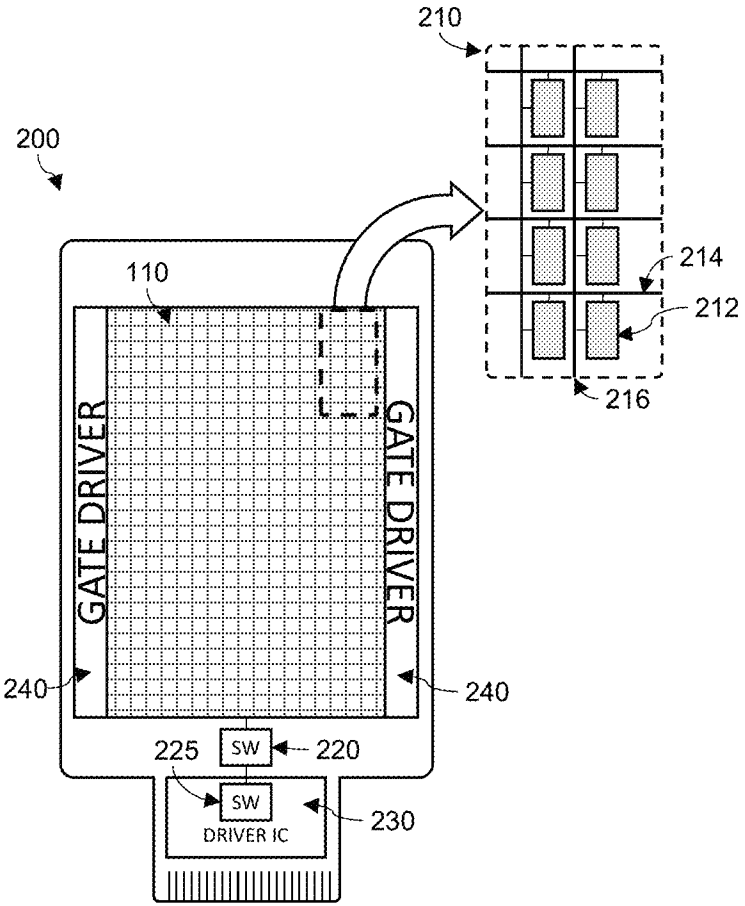
FIG. 2 schematically depicts a possible implementation of a display system for a mobile computing device.

FIG. 2 schematically depicts a possible display system that can be used with the mobile device 100 of FIG. 1. The display system 200 includes a display panel (i.e., display 110) that is controlled by electronics to render a visual output (e.g., text, graphics, video, images, etc.). The display may be any active matrix display, such as an active matrix organic light emitting diode (AMOLED) display.

A magnified portion 210 of the display 110 is shown. The magnified portion 210 illustrates the row/column configuration of pixels. Each pixel 212 is controlled by a gate signal line 214 (i.e., horizontal control lines) and by a column data line 216 (i.e., vertical control lines). All pixels in a row share the same gate signal line and all pixels in a column share the same column data line. The gate signal lines 214 of the display 110 are controlled by gate drivers 240. The column data lines are fed by a driver integrated circuit (i.e., driver IC 230). Each column data line 216 may have a panel switch 220 in series for switching (e.g., demultiplexing) data voltages from the driver IC 230 (e.g., to control the intensity of a pixel). In some implementations, the panel switch 220 may be located on a portion of a panel that includes the display 110. Additionally, a driver switch 225 may be included. For example, the driver switch may be integrated as part of the driver IC 230. The driver switch 225 can add functionality to the driver IC 230 by controlling an output impedance of the driver IC 230. While a single panel switch 220 and a single driver switch 225 are shown in FIG. 2 for clarity, the display system 200 may include a driver switch 225 and/or a panel switch 220 for each column data line in the display 110.

In some implementations, the driver switch 225 is conducting (i.e., closed or ON) while the display 110 is active and non-conducting (i.e., open or OFF). Alternatively, the driver switch 225 may be switched ON/OFF in accordance with (e.g., to match) the panel switch 220. The panel switch 220 can be switched between ON and OFF states to sequentially control pixels in a column as each row is activated, and this process is repeated for each frame of the display.

An implementation in which the driver switch 225 and panel switch 220 are simultaneously switched ON/OFF to operate the display 110 is presented in this disclosure to help understanding. The disclosure, however, is not limited to this particular implementation. For example, the principles disclosed herein may be applied to implementations in which the panel switch 220 operates alone or independently of the driver switch 225, and vice versa.

The panel switch 220 and the driver switch 225 (i.e., the switches) can affect the speed of the display 110. As mentioned previously, higher frame rates and/or longer displays (i.e., higher AR) can lead to high switching frequencies. At these frequencies, each column data line may have a high parasitic capacitance (C). When the parasitic capacitance of a column is high (i.e., large), a large ON resistance (i.e., resistance, R) of the switches can lead to a large time constant, $\tau$ (e.g., $\tau$=RC). The time constant corresponds to a period required to control a pixel in the column (e.g., change from one gray level to another). Accordingly, when a column contains many pixels and/or when the display is operated at a high frame rate, it may be desirable to reduce/minimize the resistance of the switches in order to reduce the period required to control each pixel. In other words, reducing (e.g., minimizing) the resistance of the switches may be desirable for a high frame rate operation. Additionally, reducing (e.g., minimizing) the resistance of the switches may be desirable for high AR displays, which normally have a high column line switching frequency due to the large number of pixels that must be controlled in each frame.

The switches may be embodied variously. For example, in a display system for a mobile device the switches may be embodied as P-channel, low-temperature poly-silicon (poly-Si) field effect transistor switches (i.e., PMOS switches), while in a display system for a larger displays (e.g., television) the switches may be embodied as N-channel metal oxide semiconductor field effect transistor switches (i.e., NMOS switches). The principles of the disclosure, however, can be applied to any transistor switch (e.g., BJT, MSOFET, JFET, etc.) and to any transistor technology (e.g., NMOS, PMOS, CMOS, etc.).

Reducing the resistance (e.g., the ON-state resistance) of a transistor can be accomplished by increasing the size of the transistor. For example, the channel dimensions of a PMOS switch may be increased to reduce the resistance of the switch in the ON state. A larger transistor, however, requires more power for switching (e.g., due to a larger gate capacitance) than a smaller transistor. As a result, the power consumption of a display may be increased by the use of large transistors to compensate for higher parasitic capacitances of column data lines. An aspect of the present disclosure is using a bank of transistors that are connected in parallel and that can be configured to operate in concert to avoid the use of a single large transistor switch.

Another aspect of the present disclosure is the recognition that a display (e.g., a high AR display) may not continuously operate at a high frame rate (e.g., >60 Hz). Another aspect of the present disclosure is providing switches (e.g., panel switch 220, driver switch 225) with an adjustable resistance based on a frame rate so that the overall power consumption of the display can be reduced. In another words, an aspect of the present disclosure is a display having controllable power consumption based on different operating modes (i.e., frame rates, frequencies), where the power consumption control is provided by a configuration of a switching system.

Figure 3:
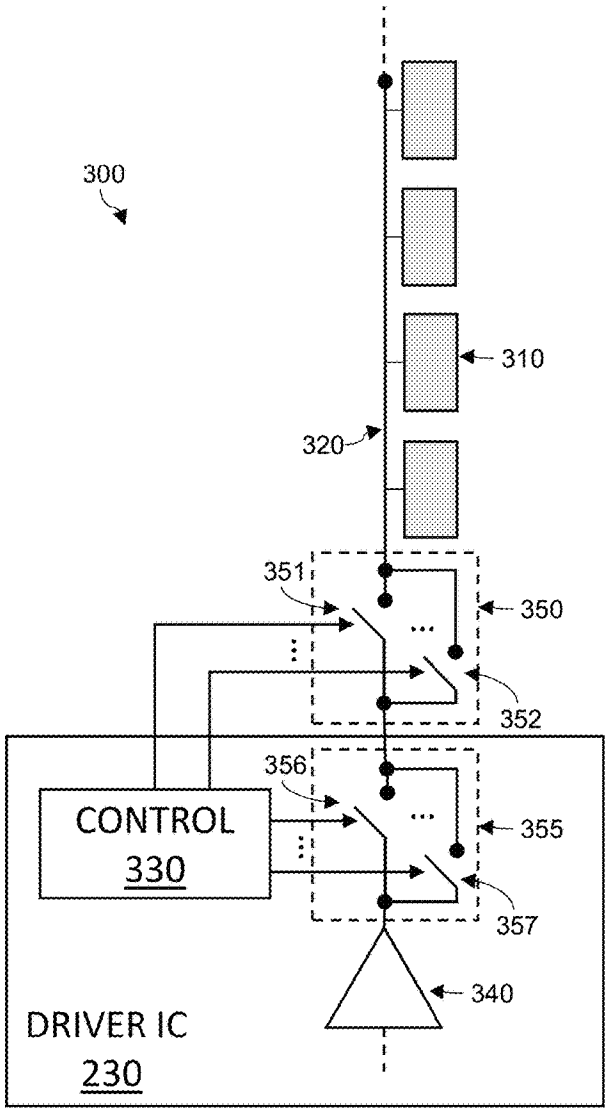
FIG. 3 schematically depicts a first possible implementation of a switching system for a column of a flat panel display.

FIG. 3 schematically depicts a first possible implementation of a switching system for a column of a flat panel display. The switching system 300 includes a column data line 320 that is coupled to a column of pixels 310. The pixels are controlled (e.g., adjusted in intensity) by a signal from an amplifier 340 included as part of the driver IC 230. The signal from the amplifier 340 is coupled/decoupled to/from the column data line 320 by switch banks.

One aspect of the present disclosure is that each column of a display includes a plurality of switch banks. The switch bank (i.e., panel-switch bank 350) in the panel portion (i.e., portion including pixels) of the display system can include multiple (e.g., two) sub-switches 351, 352 that are coupled to each other in parallel to form a panel-switch bank 350. The switch bank (i.e., driver-switch bank 355) in the driver IC 230 portion of the display system can include multiple (e.g., two) sub-switches 356, 357 that are coupled to each other in parallel to form a driver-switch bank 355. The panel-switch bank 350 and the driver-switch bank 355 are coupled in series between the amplifier 340 of the driver IC and the column data line 320 of the display. The panel-switch bank 350 and the driver-switch bank 355 may include the same number of sub-switches or may include different numbers of sub-switches. For example, the panel-switch bank 350 may include two or more sub-switches and the driver-switch bank 355 may include one sub-switch, and vice versa. The present disclosure is not limited to any particular number or range of sub-switches in each bank and is further not limited to any particular relation between the number of sub-switches used in each bank.

The plurality of sub-switches in the panel-switch bank 350 and the plurality of sub-switches in the driver-switch bank 355 may be controlled (e.g., controlled separately) by a plurality of control signals coupled to respective sub-switches from a timing control block (i.e., T-con or control 330). For the embodiment shown in FIG. 3, the control 330 is integrated with (i.e., part of) the driver IC 230. The plurality of control signals may alternate between a voltage level for controlling a switch in an ON state and a voltage level for controlling a switch in an OFF state. The signals may alternate between the ON and OFF voltage levels at the column line switching frequency for the display.

The control 330 may provide the plurality of control signals to the plurality of sub-switches differently based on an operating condition of the display. For example, in a first operating condition the control 330 may transmit a first control signal to each sub-switch in a bank of switches, while in a second operating condition the control may transmit a first control signal to a first portion of the plurality of sub-switches and a second control signal to a second portion of the plurality of sub-switches. The first control signal may be an alternating ON/OFF signal that couples/decouples the column data line to the amplifier at the column line switching frequency, and the second control signal may be a continuous OFF signal that decouples the second portion of the plurality of sub-switches from the first portion of the sub-switches. In other words, the control 330 (i.e. control block) may effectively use all, or a portion, of the plurality of sub-switches in the panel-switch bank 350 and/or the driver-switch bank 355, depending on the control signals sent to the individual sub-switches in each bank.

The control 330 may provide the same number of control signals to the panel-switch bank 350 or the driver-switch bank. Alternatively, the control 330 may provide a different number of control signals to the panel-switch bank 350 or the driver-switch bank 355. For example, the control may provide a plurality of control signals (e.g., via multiple control signal lines) to a plurality of switches in the panel-switch bank 350, while providing a single control signal (e.g., via a single control signal line) to a single switch in the driver-switch bank 355. The present disclosure is not limited to any particular number or range of control signals transmitted to each bank and is further not limited to any particular relation between the number of control signals transmitted to each switch bank.

Figure 4:
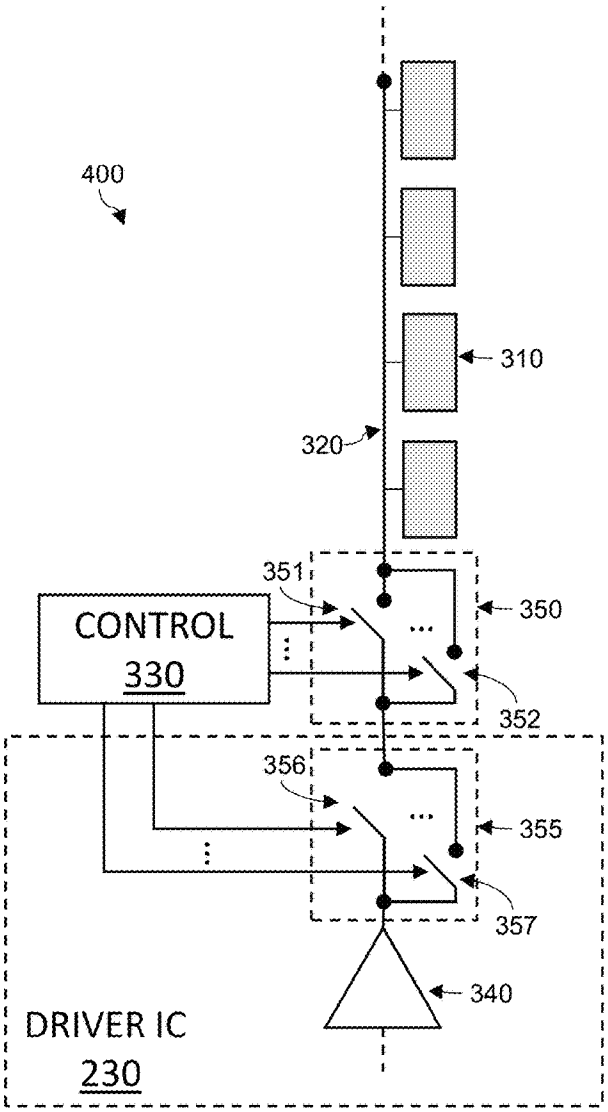
FIG. 4 schematically depicts a second possible implementation of a switching system for a column of a flat panel display.

FIG. 4 schematically depicts a second possible implementation of a switching system 400 for a column of a flat panel display. In this implementation the timing control block (i.e., T-con or control 330) is not integrated as part of the driver IC 230 and may be physically separate from the driver IC 230. Otherwise, the control 330 may operate as described previously.

Figure 5B:
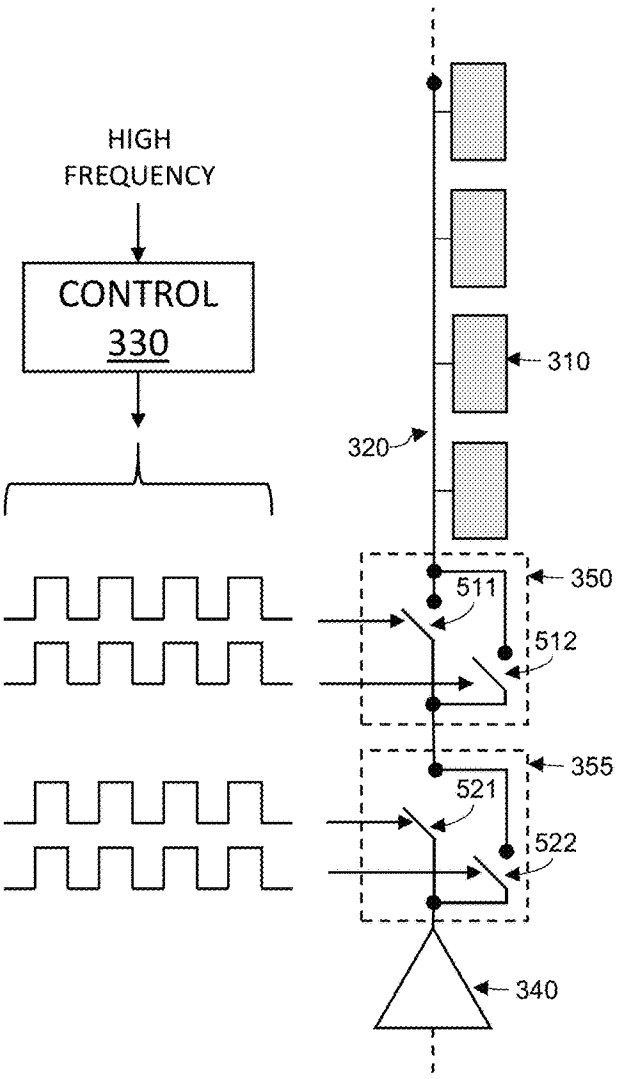
FIG. 5B depicts a switching system for a column of a display operating in a high frame rate configuration.
Figure 5A:
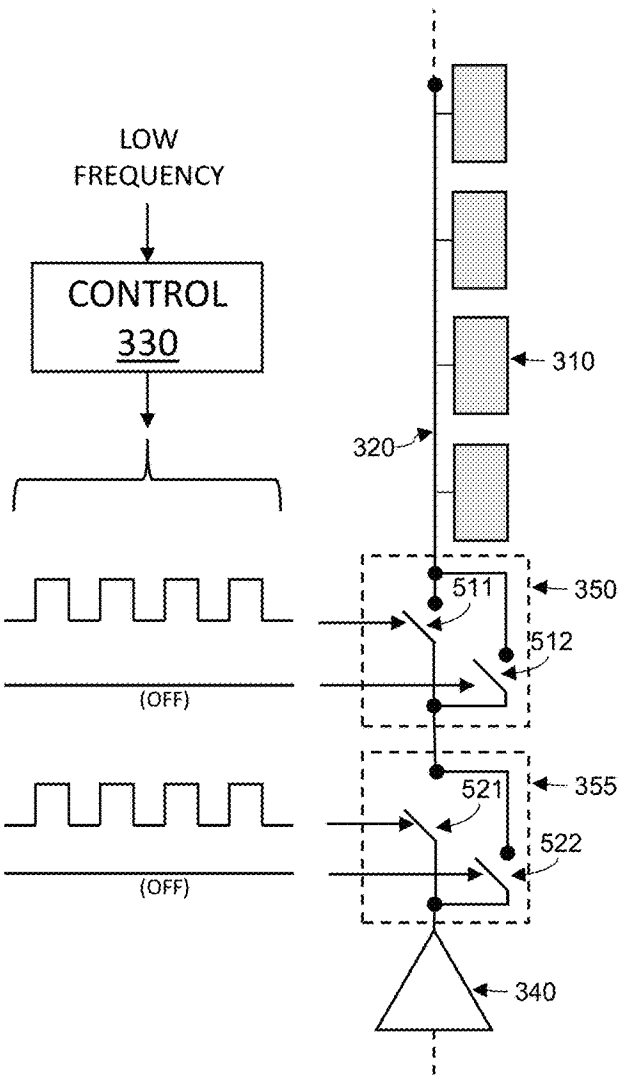
FIG. 5A depicts a switching system for a column of a display operating in a low frame rate configuration.

FIG. 5A depicts a switching system for a column of a display operating in a low frequency mode (i.e., operating at a low frame rate). A low frequency may be considered simply as a frame rate lower than another frame rate. For example, when frame rates of 60 Hz and 120 Hz are used for operation of a display, then 60 Hz is the low frequency and 120 Hz is the high frequency. The present disclosure is not limited to any particular low frame rate or range of low frame rates and is not limited to any particular high frame rate or range of high frame rates.

The switching system of FIG. 5A includes two switches in the panel-switch bank 350. In particular, the panel-switch bank 350 includes a first panel switch 511 and a second panel switch 512. The switching system of FIG. 5A also includes two switches in the driver-switch bank 355. In particular, the driver-switch bank 355 includes a first driver switch 521 and a second driver switch 522. In this implementation the control 330 can determine that the frame rate of the display has a low frequency (i.e., the display is running with a low frame rate). The control 330 may determine a current frame rate (i.e., as low frequency) by receiving a signal indicating the frame rate. Alternatively, the control 330 may determine a current frame rate by applying an algorithm to display signals that do not directly indicate the frame rate but rather correspond to the frame rate.

Upon determining that the display is operating with (or requires) a frame rate considered to be low frequency (e.g., 60 Hz), the control 330 effectively deactivates (i.e., decouples, turns OFF, opens, disconnects, etc.) a portion of the switches in each bank to reduce power consumption. For example, a signal or signals may be applied to open a plurality of sub-switches so that they are disconnected from the switch bank while the frame rate is low.

For the implementation shown in FIG. 5A the control, sends (i.e., transmits) a first control signal to turn OFF (i.e., open) the second panel switch 512 and to turn OFF (i.e., open) the second driver switch 522. Meanwhile, the control 330 sends a second control signal to toggle the first panel switch 511 and the first driver switch 521 ON/OFF in accordance with display operation. The resistance of each bank of switches (in the ON state) is increased by disabling a portion of the sub-switches, but the power consumption of each bank is reduced. In this low frequency operation, the aggregate load capacitance driven by the control 330 decreases as a result of driving only a portion of the switches. Accordingly, the (dynamic) power consumption of the control is decreased, which corresponds to a lower power consumption of the display system. As mentioned, an increase in the ON resistance of each bank of switches results in an increase in a time constant that associated with the control (i.e., row-line program time) of a pixel. In particular, the time constant is proportional to the ON resistance of the switches and the parasitic capacitance of the column data line coupled to the switches. The increased time constant caused by driving only a portion of the switches does not affect operation of the display because the row-line program time required for low frame rate operation is longer. Thus, an aspect of the present disclosure is a switch system for a display that includes banks of switches that can be partially disabled to reduce power consumption at low frame rates without affecting a performance of the display. In the example implementation of FIG. 5A, a low frame rate configuration effectively uses the first panel switch 511 in the panel-switch bank 350 and the first driver switch 521 in the driver-switch bank 355. This low frame rate configuration provides a high ON resistance but reduces the power consumed.

FIG. 5B depicts a switching system for a column of a display operating in a high frequency mode (i.e., display operating at a high frame rate). Upon determining that the display is operating with (or requires) a frame rate considered to be high frequency (e.g., 120 Hz), the control 330 effectively activates all of the switches in each bank to reduce ON resistance.

For the implementation shown in FIG. 5B, the control 330, transmits a control signal to toggle the first panel switch 511, the second panel switch 512 ON/OFF together for normal operation. Likewise, the control 330 transmits a control signal to toggle the first driver switch 521 and the second driver switch 522 ON/OFF in accordance with display operation. The resistance of each bank of switches (in the ON state) is decreased by enabling all of the sub-switches, and the power consumption at the banks is increased. In high frequency operation, a time required for row-line programming of pixels is less than in low frequency operation. Accordingly, the reduction of the ON resistance of each bank of switches reduces the time constant associated with the control (i.e., row-line program time) of pixels to accommodate the high frequency operation. In other words, when the frame rate is increased, the time constant to control switches can be maintained (or reduced) by reducing the ON resistance of the switches. Thus, another aspect of the present disclosure is a switch system for a display that includes banks of switches that can be fully enabled to reduce resistance at high frame rates. In the example implementation of FIG. 5B, a high frame rate configuration uses both sub-switches in the panel-switch bank 350 and both sub-switches in the driver-switch bank 355. This high frame rate configuration provides a low ON resistance to increase the display speed with an increase in the power consumed. In other words, the implementation shown in FIG. 5B may consume more power than the implementation shown in FIG. 5A because more switches are be controlled. The power consumed by FIG. 5B may be comparable to an implementation that uses one large (i.e., low ON-resistance) switch. An advantage of a controllable switch bank over a single large switch occurs when the display is operated a low frame rate. In this case, the power drawn (i.e., consumed) by the controllable switch bank is lower than a single large switch. For displays that operate in both high and low frame rates over time, less overall power is consumed.

Figure 6:
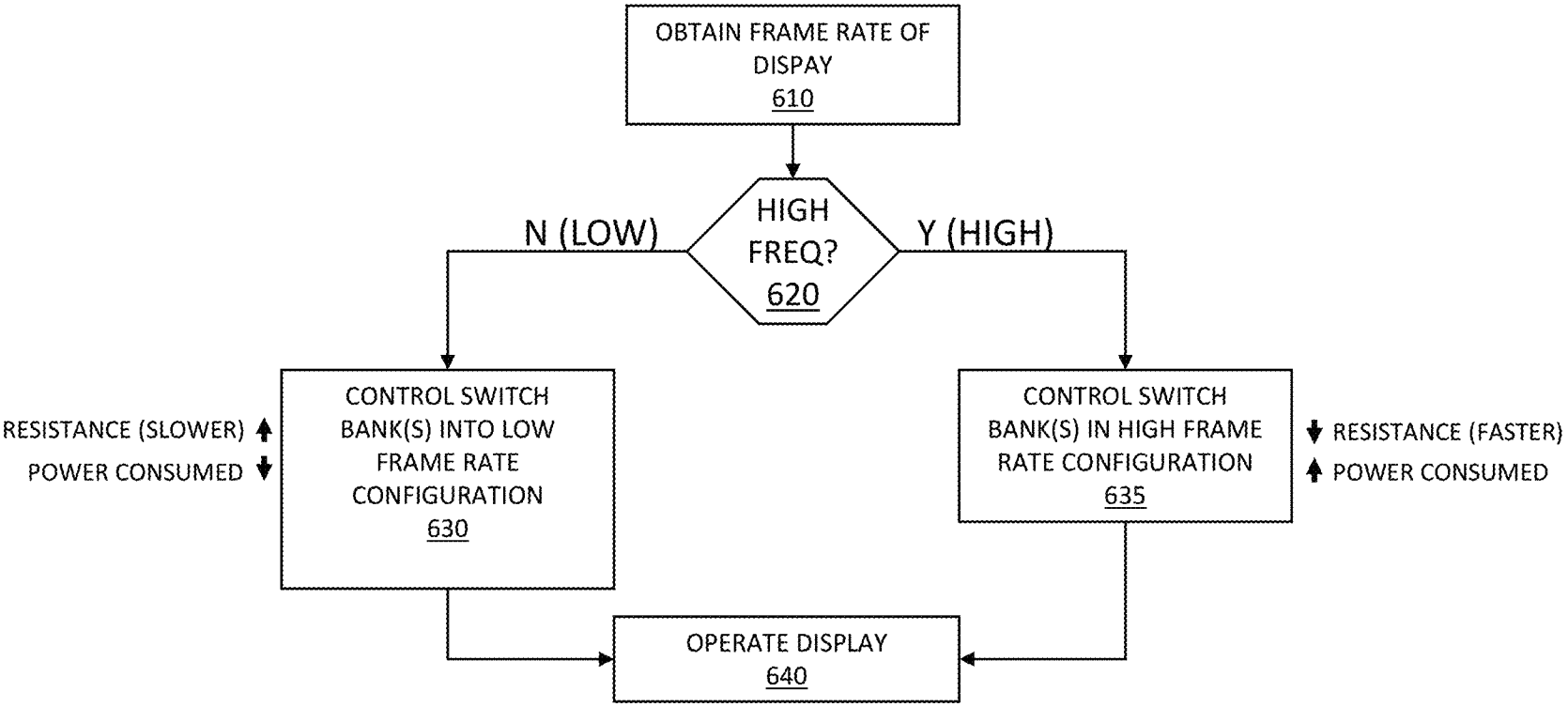
FIG. 6 depicts a method of operating a display according to an implementation of the present disclosure.

FIG. 6 is a flow chart of a method for controlling a display. The method includes obtaining 610 a frame rate of the display (e.g., receive at control 330). Next, the frame rate is determined to be low or high 620. For example, an obtained frame rate may be compared to a threshold that defines a boundary between high frame rates and low frame rates and if the frame rate is above the threshold then the frame rate is high frequency and if it is below the threshold then the frame rate is low frequency. If the frame rate is determined to be low, then a switch bank (or switch banks) can be controlled 630 in a low frame configuration to operate 640 the display. For example, a portion of a plurality of sub-switches in a switch bank, which couples the driver IC and the column data line of the display, can be deactivated using a continuous OFF signal. If, on the other hand, the frame rate is determined to be high, then a switch bank (or switch banks) can be controlled 635 in a high frame rate configuration. For example, all sub-switches in a switch bank that couples the driver IC and the column data line of the display can all receive the same control signal to operate 640 the display.

While two alternatives are shown in the method of FIG. 6, the principles of the disclosure may be applied to more ranges. For example, the frame rate may be determined to be in one of a plurality of ranges and for the range an appropriate number of sub-switches in a switch bank may be activated (or deactivated) in order to provide an appropriate ON resistance and/or an appropriate power consumption for the determined range.

In the specification and/or figures, typical embodiments have been disclosed. The present disclosure is not limited to such exemplary embodiments. The use of the term "and/or" includes any and all combinations of one or more of the associated listed items. Unless otherwise noted, specific terms have been used in a generic and descriptive sense and not for purposes of limitation. As used in this specification, spatial relative terms (e.g., in front of, behind, above, below, and so forth) are intended to encompass different orientations of the device in use or operation in addition to the orientation depicted in the figures. For example, a "front surface" of a mobile computing device may be a surface facing a user, in which case the phrase "in front of" implies closer to the user.

While certain features of the described implementations have been illustrated as described herein, many modifications, substitutions, changes, and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components, and/or features of the different implementations described.

What is claimed is:

1. A method for controlling a display, the method comprising:

obtaining a frame rate of the display;

comparing the frame rate to a threshold that defines a boundary between high frame rates and low frame rates;

determining that the frame rate is low based on the comparison; and deactivating at least one sub-switch of a plurality of sub-switches in a panel-switch bank to reduce a number of sub-switches used to couple a driver integrated circuit (IC) and a column data line of the display.

2. The method for controlling a display according to claim 1, wherein the frame rate that is determined low is 60 Hertz.

3. The method for controlling a display according to claim 1, wherein the plurality of sub-switches are connected in parallel with one another and wherein deactivating the at least one sub-switch comprises applying a signal to open the the at least one sub-switch so that the at least one sub-switch is disconnected from the panel-switch bank while the frame rate is low.

4. The method for controlling a display according to claim 1, further comprising:

determining that the frame rate is high; and in response to the determination that the frame rate is high, activating all of the plurality of sub-switches in the panel-switch bank to increase the number of sub-switches used to couple the driver IC and the column data line of the display to reduce an ON resistance of the panel-switch bank while the frame rate is high.

5. The method for controlling a display according to claim 4, wherein, while the frame rate is high, all of the plurality of sub-switches in the panel-switch bank are simultaneously controlled ON and OFF according to a column line switching frequency.

6. The method for controlling a display according to claim 1, further comprising deactivating the at least one sub-switch of the plurality of sub-switches in the driver-switch bank to reduce a power consumption of the display while the frame rate is low, the driver-switch bank coupled between a driver integrated circuit (IC) and the panel-switch bank.

7. The method for controlling a display according to claim 6, further comprising:

determining that the frame rate is high; and in response to the determination that the frame rate is high, activating all of the plurality of sub-switches in the driver-switch bank to reduce a resistance of the driver-switch bank while the frame rate is high.

8. The method for controlling a display according to claim 7, further comprising controlling each of the plurality of sub-switches as the plurality of sub-switches in the panel-switch bank are controlled.

9. The method of claim 1, wherein the display includes a plurality of column data lines, each column data line coupling the driver IC to a plurality of pixels of the display, wherein each column data line is coupled to the driver IC by at least two of the sub-switches between the driver IC and column data line, wherein the sub-switches are arranged in parallel with each other, and wherein deactivating the portion of the plurality of sub-switches in the panel-switch bank includes, for each of the column data lines, deactivating at least one sub-switch that couples the column data line to the driver IC.

10. A display system comprising:

a display panel having a plurality of columns of pixels, each column controlled by a column data line that is coupled through a panel-switch bank associated with the column data line that controls column to a driver integrated circuit (IC); and a control configured to determine a frame rate of the display panel and to control the panel-switch bank based on the determined frame rate, wherein each panel-switch bank associated with a column data line includes a plurality of sub-switches coupled in parallel to one another, the panel-switch bank being coupled in series between the driver IC and the column data line associated with the panel-switch bank.

11. The display system according to claim 10, wherein the control is configured to control the panel-switch bank by:

switching all sub-switches of each panel-switch bank ON and OFF together when the frame rate is determined to be high relative to a threshold; and switching a portion of the sub-switches of each panel-switch bank ON and OFF together when the frame rate is determined to be low relative to the threshold.

12. The display system according to claim 11, wherein the control is configured to, when the frame rate is determined to be low, switch OFF a remaining portion of the sub-switches of the panel-switch bank.

13. The display system according to claim 10, further comprising a driver-switch bank in series with the panel-switch bank, the driver-switch bank including a plurality of sub-switches.

14. The display system according to claim 13, wherein the control is configured to control the driver-switch bank by:

switching all sub-switches of the driver-switch bank ON and OFF together when the frame rate is determined to be high; and switching a portion of the switches of the driver-switch bank ON and OFF together when the frame rate is determined to be low.

15. The display system according to claim 14, wherein the control is configured to, when the frame rate is determined to be low, switch OFF a remaining portion of sub-switches in the driver-switch bank.

16. The display system according to claim 10, wherein the control is part of the driver IC.

17. The display system according to claim 10, wherein the control is physically separate from the driver IC.

18. The display system according to claim 10, wherein the display panel has an aspect ratio greater than 18.5 to 9.

19. A flat panel display, comprising:

a plurality of panel-switch banks, each panel-switch bank configured to couple a driver integrated circuit (IC) to a column of pixels, wherein each panel-switch bank is configurable to:

couple using a high frame rate configuration that increases power consumed to provide a lower ON resistance when the display operates at a high frame rate; and couple using a low frame rate configuration that provides a higher ON resistance to reduce the power consumed when the display operates at a low frame rate, the high frame rate greater than the low frame rate.

20. The flat panel display according to claim 19, wherein each panel-switch bank comprises a plurality of sub-switches connected in parallel with one another, and wherein:

in the high frame rate configuration, all of the sub-switches in each panel-switch bank are used to couple the driver IC to one column of pixels; and in the low frame rate configuration, a portion of the sub-switches in each panel-switch bank are used to couple the driver IC to one column of pixels.

* * * * *